US007184673B2

(12) United States Patent
Asakura

(10) Patent No.: US 7,184,673 B2
(45) Date of Patent: Feb. 27, 2007

(54) IMAGE FORMING DEVICE AND IMAGE FORMING METHOD

(75) Inventor: Masanori Asakura, Otsu (JP)

(73) Assignee: Murata Kikai Kabushiki Kaisha, Kyoto (JP)

( * ) Notice: Subject to any disclaimer, the term of this patent is extended or adjusted under 35 U.S.C. 154(b) by 153 days.

(21) Appl. No.: 10/991,208

(22) Filed: Nov. 17, 2004

(65) Prior Publication Data

US 2005/0129417 A1 Jun. 16, 2005

(30) Foreign Application Priority Data

Dec. 16, 2003 (JP) ..... 2003-418489

(51) Int. Cl.
*G03G 15/00* (2006.01)

(52) U.S. Cl. ..... 399/24; 399/27; 399/30

(58) Field of Classification Search ..... 399/258, 399/57, 27, 28, 81, 61
See application file for complete search history.

(56) References Cited

U.S. PATENT DOCUMENTS 6,813,452 B2 * 11/2004 Jung et al. ..... 399/49
6,944,410 B2 * 9/2005 Naito et al. ..... 399/27
2001/0043814 A1 * 11/2001 Abe ..... 399/27
2006/0029404 A1 * 2/2006 Hirota et al. ..... 399/27

FOREIGN PATENT DOCUMENTS

| | | |
|---|---|---|
| JP | 02-10268 | 8/1990 |
| JP | 10-301385 | 11/1998 |
| JP | 2000-162930 | 6/2000 |
| JP | 2000-275950 | 10/2000 |
| JP | 2000-347490 | 12/2000 |
| JP | 2001-117338 | 4/2001 |
| JP | 2001-117343 | 4/2001 |
| JP | 2001-194889 | 7/2001 |
| JP | 2001-215784 | 8/2001 |
| JP | 2001-290358 | 10/2001 |
| JP | 2002-328511 | 11/2002 |

* cited by examiner

*Primary Examiner*—David M. Gray
*Assistant Examiner*—David Blackshire
(74) *Attorney, Agent, or Firm*—Hogan & Hartson LLP

(57) ABSTRACT

An image forming device includes a developer container sectioned into a plurality of chambers, an image forming unit which forms an image by using a developer supplied from the developer container, sensors which are respectively provided in at least two of the chambers of the developer container and detect the remaining amount of the developer in the chambers, and a determining unit which determines a status of the developer in the developer container in accordance with the remaining amount of the developer detected by the sensors.

20 Claims, 5 Drawing Sheets

FIG. 5

211

| FIRST CHAMBER | WARNING SIGNAL INPUT | | WARNING SIGNAL NOT INPUT | |
|---|---|---|---|---|
| SECOND CHAMBER | SECONDARY REMAINING AMOUNT OR LARGER | LESS THAN SECONDARY REMAINING AMOUNT | SECONDARY REMAINING AMOUNT OR LARGER | LESS THAN SECONDARY REMAINING AMOUNT |
| STATUS | DEVELOPER SOLIDIFIED | | SUFFICIENT AMOUNT TO FEW AMOUNT | REPLENISHING NECESSARY |

212

| FIRST CHAMBER | PRIMARY REMAINING AMOUNT OR LARGER | LESS THAN PRIMARY REMAINING AMOUNT | PRIMARY REMAINING AMOUNT OR LARGER | LESS THAN PRIMARY REMAINING AMOUNT |
|---|---|---|---|---|
| SECOND CHAMBER | WARNING SIGNAL NOT INPUT | | WARNING SIGNAL INPUT | |
| STATUS | SUFFICIENT AMOUNT TO FEW AMOUNT | DEVELOPER DETERIORATED | DEVELOPER SOLIDIFIED | REPLENISHING NECESSARY |

IMAGE FORMING DEVICE AND IMAGE FORMING METHOD

BACKGROUND OF THE INVENTION

1. Field of the Invention

The present invention relates to an image forming device and an image forming method use to form an image by using a developer supplied from a developer container.

2. Description of the Related Art

An image forming device includes a developer container and an image forming unit. The developer container stores a developer such as a toner. The image forming unit forms an image on a recording material such as recording paper by using the developer supplied from the developer container. In case the developer container is sectioned into a plurality of chambers, conventionally, a sensor for detecting the presence or the absence of the developer or a remaining amount of the developer in the developer container is provided only in one of the chambers of the image forming device.

In case a solidification (bridge) of the developer is generated in the developer container, there are cases in which the developer does not transfer from the developer container to the image forming unit. However, since a detector detects a presence of the solidified developer, the image forming device determines that the developer is present in the developer container. As a result, there are cases in which although the developer is present in the developer container, the developer is not supplied to the image forming unit.

From the above-described circumstance, there is a demand for an image forming device which can detect the presence or the absence of the developer or the remaining amount of the developer in the developer container and also the solidification of the developer. However, in case of adding a detector for detecting the solidification of the developer, there is a drawback that a structure of the image forming device becomes complicated.

SUMMARY OF THE INVENTION

A first advantage of the present invention is to determine a status of a developer, such as the presence or the absence of the developer, a remaining amount of the developer and whether the developer is solidified, by providing a sensor for detecting the remaining amount of developer in a developer container sectioned into a plurality of chambers.

A second advantage of the present invention is to determine the status of a developer in a developer container by a simple structure in accordance with a detection result of a first remaining amount detecting function of a first sensor and a detection result of a second remaining amount detecting function of a second sensor.

A third advantage of the present invention is to provide an image forming device and an image forming method which can determine a status of a developer by an even more simple structure by detecting a remaining amount of a developer by a first remaining amount detecting function of one sensor and not detecting the remaining amount of the developer by a first remaining amount detecting function of another sensor.

According to a first aspect of the present invention, an image forming device includes a developer container sectioned into a plurality of chambers. The image forming device forms an image by using a developer supplied from the developer container. The image forming device includes sensors and a determining unit. The sensors are provided in each of at least two of the chambers of the developer container, respectively. The sensors detect a remaining amount of the developer in the chambers. The determining unit determines a status of the developer in the developer container in accordance with the remaining amount of the developer detected by each of the sensors.

According to the first aspect, in case the developer container is sectioned into a plurality of chambers, the developer in one chamber is transferred to another chamber. The developer in the other chamber is supplied to the outside of the developer container. Then, by using the supplied developer, an image is formed. The sensors are formed of, for example, a general sensor (a magnetic sensor, a photo detector, etc.) for detecting the presence or the absence of the developer or the remaining amount of the developer. The sensors detect the remaining amount of the developer in the chambers in which the sensors are equipped. The determining unit is formed of a general operational element or the like. In accordance with the remaining amount of the developer detected by the sensors, the determining unit determines the status of the developer in the developer container (for example, the presence or the absence of the developer, the remaining amount of the developer and/or whether the developer is solidified). In this case, when the developer is not detected in the other chamber even though the developer is remaining in one chamber, the determining unit determines that the developer is solidified in one chamber.

The determination of whether or not the developer is solidified can be determined in accordance with the presence or the absence of the developer in each of the chambers. However, just by determining the presence or the absence of the developer, until the developer runs out, the image forming device cannot notify a user as to the time for replenishing the developer. Therefore, before the developer runs out, a notification cannot be made to urge the user to prepare a new developer. Accordingly, convenience of the user cannot be improved. Thus, at least one of the sensors is required to detect the remaining amount of the developer precisely.

According to a second aspect of the present invention, each of the sensors includes a first remaining amount detecting function and a second remaining amount detecting function. The first remaining amount detecting function detects the remaining amount of the developer in the chamber in which the sensor is equipped. The second remaining amount detecting function detects whether or not the developer of a prescribed amount or larger is remaining in the chamber in which the sensor is equipped. The determining unit determines the status of the developer in the developer container in accordance with the detection result of the first remaining amount detecting function of one sensor and the detection result of the second remaining amount detecting function of the other sensor.

According to the second aspect, the first remaining amount detecting function precisely detects the remaining amount of the developer in the chamber. The second remaining amount detecting function roughly detects the remaining amount of the developer in the chamber (for example, detects only the presence or the absence of the developer). The determining unit determines the status of the developer in the developer container in accordance with the detection result of the first remaining amount detecting function of one sensor and the detection result of the second remaining amount detecting function of the other sensor. The determination of the status of the developer based on a plurality of precise detection results is complicated. However, the determination of the status of the developer based on a precise detection result and a rough detection result is simple. Therefore, the entire processing of the sensors becomes simple compared with an entire processing of sensors in which all of one sensor and the other sensor precisely detect the remaining amount of the developer and the determination is carried out in accordance with a plurality of precise detection results.

In case one sensor includes only the first remaining amount detecting function and the other sensor includes only the second remaining amount detecting function, when an amount of the developer replenished in the developer container changes (for example, when the developer container is sectioned into three chambers and the developer is replenished in fill two chambers at a shipment from a factory and the developer is replenished to fill three chambers thereafter), there are cases in which the status of the developer cannot be determined accurately. Therefore, each of the sensors includes both the first remaining amount detecting function and the second remaining amount detecting function.

According to a third aspect of the present invention, the image forming device includes a unit for detecting the remaining amount of the developer by the first remaining amount detecting function of one sensor and not detecting the remaining amount of the developer by the first remaining amount detecting function of the other sensor.

According to the third aspect, only one of the first remaining amount detecting function of one sensor and the first remaining amount detecting function of the other sensor precisely detects the remaining amount of the developer. Although the precise detection of the remaining amount of the developer is complicated, the rough detection of the remaining amount of the developer is simple. Therefore, the entire processing of the sensors becomes simple compared with an entire signal processing of sensors in which all of the first remaining amount detecting function of one sensor and the first remaining amount detecting function of the other sensor precisely detect the remaining amount of the developer.

BRIEF DESCRIPTION OF THE SEVERAL VIEWS AND THE DRAWING(S)

FIG. 5 shows examples of data stored in a Read Only Memory (ROM) provided in the MFP according to an embodiment of the present invention.

DETAILED DESCRIPTION OF THE INVENTION

In the following, embodiments of the present invention will be described with reference to the drawings. In the present embodiment, a MFP which is an electrophotographic image forming device is exemplified as an image forming device of the present invention. However, the present invention is not limited to this example.

Figure 1:
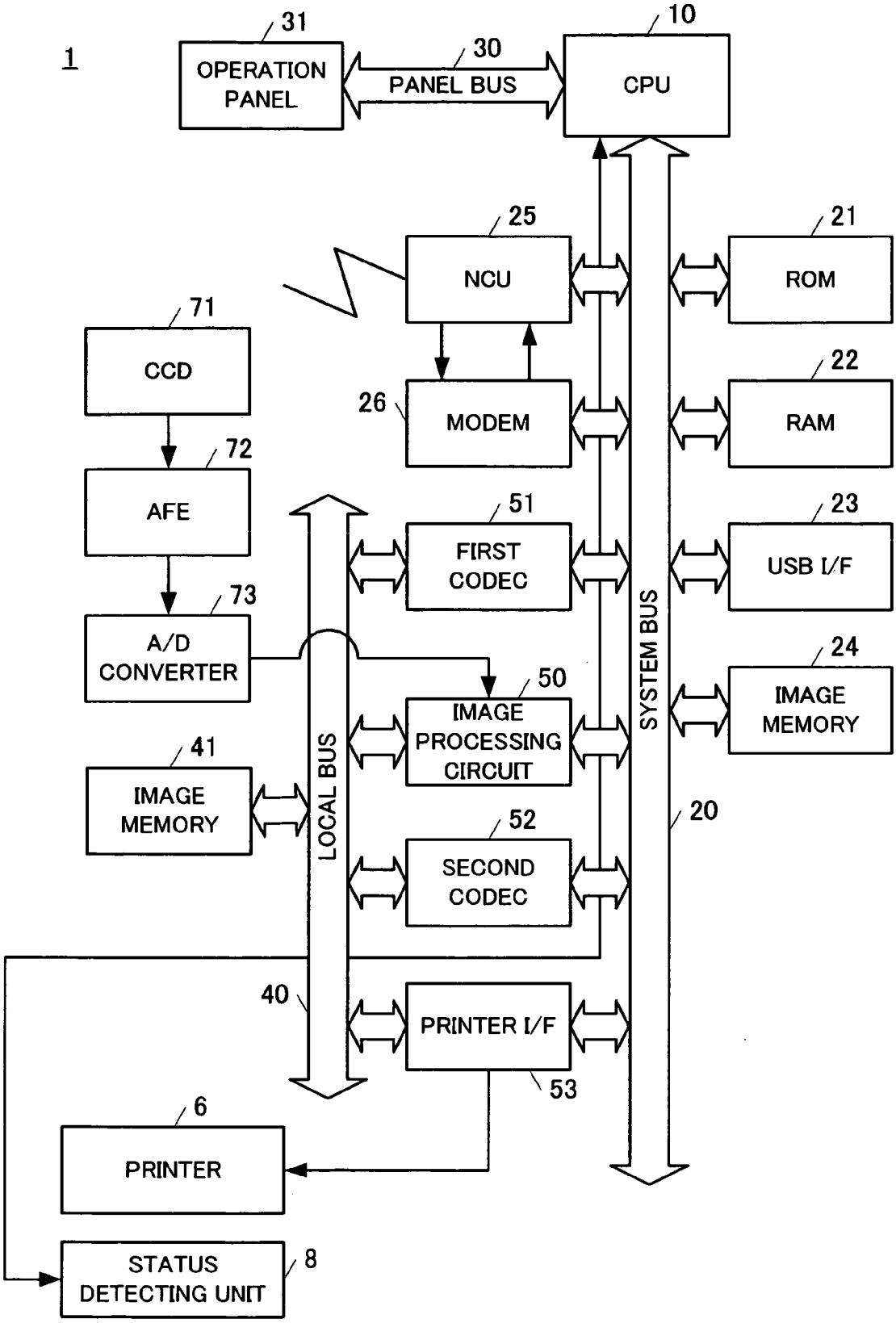
FIG. 1 is a block diagram showing a configuration of a Multi Function Peripheral (MFP) which is an image forming device according to an embodiment of the present invention.

FIG. 1 is a block diagram showing a configuration of a MFP 1 which is an image forming device according to an embodiment of the present invention. In the MFP 1 of the present embodiment, a Central Processing Unit (CPU) 10, which is a processor as a control unit, implements the following functions in accordance with a computer program stored in a Read Only Memory (ROM) 21. The functions include, for example, a scanning function for scanning an image of an original document, an output function for copying (printing out) a scanned image, a transmitting function for transmitting image data by facsimile and a printing function for printing out image data received by facsimile. The MFP 1 includes a system bus 20 and a panel bus 30 which are connected directly to the CPU 10, and a local bus 40 which is not connected directly to the CPU 10. The CPU 10 is connected to the ROM 21 and a Random Access Memory (RAM) 22 via the system bus 20. The RAM 22 is used as a memory for storing various pieces of information. Furthermore, the CPU 10 is connected to a status detecting unit 8 for detecting a status of a developer (the presence or the absence, a remaining amount, a solidification and a deterioration of the developer).

The ROM 21 stores the computer program and also various data such as tables shown in FIG. 5 to be described later. Further, when a flash memory is used in place of the ROM 21, the stored computer program and/or various data can be rewritten.

Other than the CPU 10, the ROM 21 and the RAM 22, a Universal Serial Bus Interface (USB I/F) 23, an image memory 24, a Network Control Unit (NCU) 25 and a modular-demodulator (modem) 26 are connected to the system bus 20. An operation panel 31 is connected to the panel bus 30. An image memory 41 for storing input image data is connected to the local bus 40. An image processing circuit 50, a first coder-decoder (CODEC) 51, a second CODEC 52 and a printer I/F 53 are connected to both the system bus 20 and the local bus 40. A Charge Coupled Device (CCD) 71, an Analog Front End (AFE) 72 and an Analog-to-Digital (A/D) converter 73 are connected in this order. The A/D converter 73 is connected to the image processing circuit 50. The printer I/F 53 is connected to a printer 6. The NCU 25 and the modem 26 are connected to one another.

The modem 26 can carry out facsimile communication. The NCU 25 is hardware for making and breaking an analog line with a Public Switched Telephone Network (PSTN). The NCU 25 connects the modem 26 to the PSTN according to necessity so that facsimile communication can be carried out with another facsimile machine.

The USB I/F 23 enables a connection between the MFP 1 (the system bus 20 of the MFP 1) and a remote device (for example, a personal computer in which image processing software is installed).

The image memory 24 stores input image data or facsimile image data. The image data stored in the image memory 24 is image data received from a remote device via the USB I/F 23 or image data to be sent to a remote device. The facsimile image data stored in the image memory 24 is facsimile image data received by the modem 26 via the NCU 25 or facsimile image data to be sent to a remote device via the modem 26 and the NCU 25. Further, the image data received from the remote device via the USB I/F 23 can be input to the image memory 41, for example, via the system bus 20, the second CODEC 52 and the local bus 40.

The operation panel 31 includes character keys, a ten-key numeric pad, a speed dial key, a one-touch dial key, various function keys and a display device using a Liquid Crystal Display (LCD) or the like that are necessary for operating the MFP 1.

The CCD 71, the AFE 72 and the AID converter 73 are provided in a scanner (not shown). An analog pre-processing is executed by the AFE 72 on a signal scanned from an original document by the CCD 71. The pre-processed analog signal is converted into a digital signal by the A/D converter 73. Then, the digital signal is processed by the image processing circuit 50. For example, the digital signal is converted into image data of a binary of black and white. The converted image data is output from the image processing circuit 50 to the image memory 41.

The first CODEC 51 codes the image data stored in the image memory 41 (for example, image data scanned from an original document by the scanner) into facsimile image data. Then, the first CODEC 51 outputs the facsimile image data to the image memory 24. The second CODEC 52 decodes the facsimile image data stored in the image memory 24 (for example, facsimile image data received from a remote device via the NCU 25 and the modem 26). Then, the second CODEC 52 outputs the decoded image data to the image memory 41.

The printer I/F 53 is an interface between the system bus 20 and the local bus 40, and the printer 6. The image data stored in the image memory 24 or the image memory 41 is output to the printer 6 via the printer I/F 53. The printer 6 is an image forming unit which forms (prints out) an image by using the developer. When forming an image, various control signals are input and output between the printer 6 and the CPU 10 via the printer I/F 53.

Figure 2:
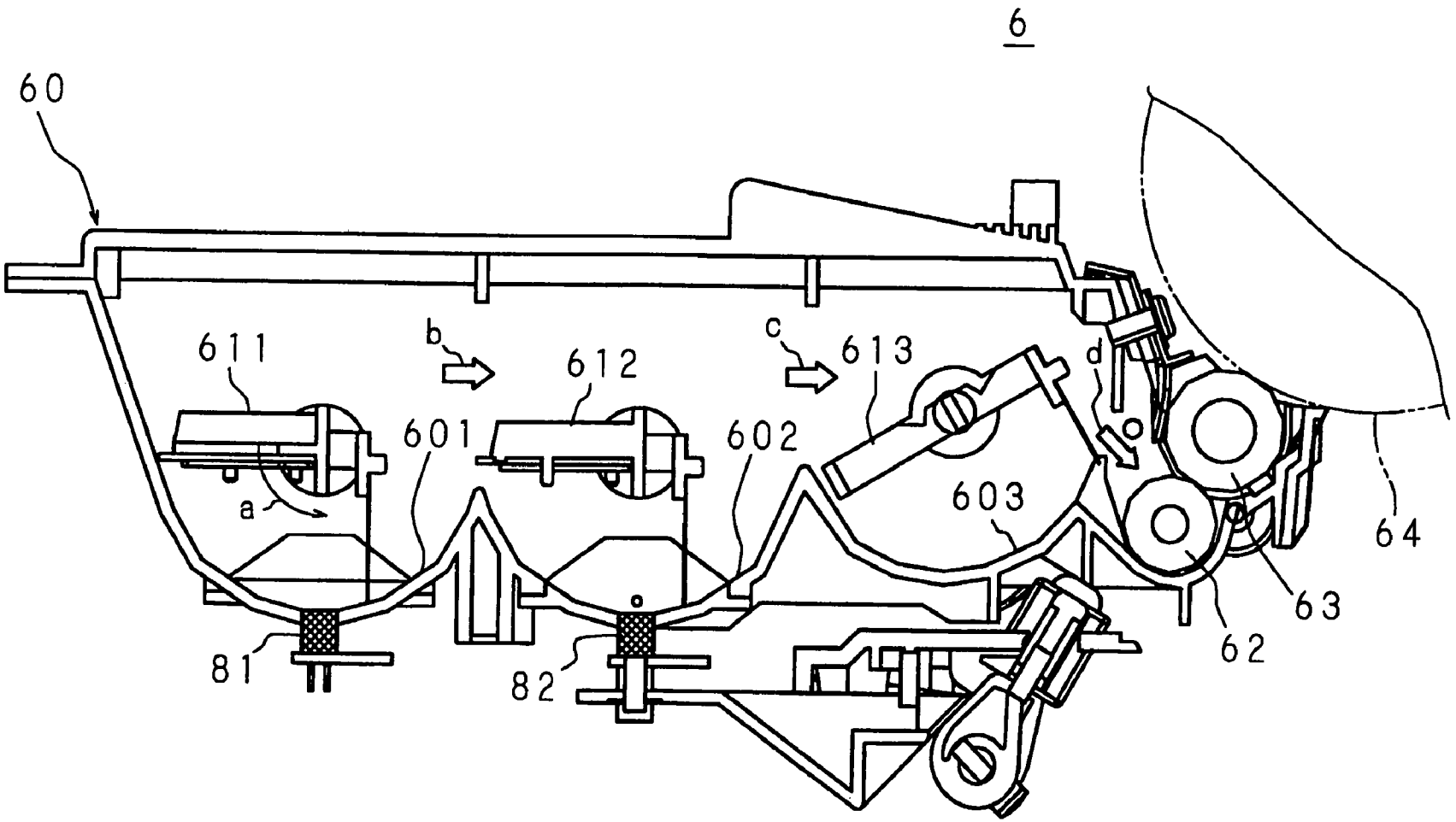
FIG. 2 shows an inner structure of a developer container provided in the MFP according to an embodiment of the present invention.

FIG. 2 shows an inner structure of a developer container 60 of the MFP 1. The developer container 60 is provided in the printer 6. Other than the developer container 60, the printer 6 includes a development roller 63 and a photoconductive drum 64. The printer 6 supplies the developer stored in the developer container 60 to the photoconductive drum 64 by the development roller 63. The printer 6 selectively adheres the developer to an electrostatic latent image formed on the photoconductive drum 64. Then, the printer 6 develops the electrostatic latent image. After transferring the developed image onto recording paper which is a recording material, the image is heated and pressured and fused onto the recording paper. That is, the developer container 60 constitutes a developing unit for adhering the developer onto the photoconductive drum 64.

The developer container 60 is sectioned into three chambers 601, 602 and 603. A replenish opening (not shown) is formed on the first chamber 601 for replenishing the developer into the developer container 60. The third chamber 603 includes a supply roller 62. The supply roller 62 is disposed facing the development roller 63. The supply roller 62 adheres the developer in the developer container 60 onto the development roller 63. The second chamber 602 is provided between the first chamber 601 and the third chamber 603. The developer container 60 is a unit which is inserted removably into the printer 6. When a remaining amount of the developer in the developer container 60 becomes "0", the user removes the developer container 60 from the printer 6. Then, the user replenishes the developer from the replenish opening of the first chamber 601. After replenishing the developer, the user mounts the developer container 60 in the printer 6. Alternatively, an empty developer container 60 can be replaced with a new developer container 60. In this case, the developer container 60 is mounted so that a circumferential surface of the supply roller 62 makes close contact with a circumferential surface of the development roller 63 and rotational shafts of each roller are positioned approximately in parallel with one another.

In each of the chambers 601, 602 and 603, a prescribed amount of the developer can be stored, respectively. In the following, when the remaining amount of the developer stored in one chamber is equal to the prescribed amount of the developer in that chamber, the remaining amount of the developer in this chamber is 100%. When the remaining amount of the developer stored in one chamber is "0", the remaining amount of the developer in that chamber is 0%.

Agitators 611, 612 and 613 like a paddle are provided in each of the chambers 601, 602 and 603, respectively. The first agitator 611 rotates in a direction of an arrow (a) and agitates the developer stored in the first chamber 601. The agitated developer transfers in a direction of an outlined arrow (b) and is stored in the second chamber 602. In the same manner, the second agitator 612 agitates the developer in the second chamber 602. The agitated developer transfers in a direction of an outlined arrow (c) and is stored in the third chamber 603. The third agitator 613 agitates the developer in the third chamber 603. The agitated developer transfers in a direction of an outlined arrow (d) and is supplied to the photoconductive drum 64 via the supply roller 62 and the development roller 63. The printer 6 includes a motor (not shown) which rotates the agitators 611, 612 and 613. The CPU 10 controls to rotate or stop the agitators 611, 612 and 613 by transmitting a prescribed control signal to the motor via the printer I/F 53.

In case of using the developer container 60 sectioned into three chambers 601, 602 and 603, when shipping the MFP 1 from the factory, the developer container 60 of the printer 6 stores the developer of an amount so that the remaining amount of the developer in each of the chambers 602 and 603 becomes 100% (hereinafter referred to as the "factory-shipped developer"). A refill developer to be replenished into the developer container 60 after the shipment from the factory or a developer stored in a replacement developer container 60 is the developer of an amount so that the remaining amount of the developer in each of the chambers 601, 602 and 603 becomes 100% (hereinafter referred to as the "replenishing developer").

In case of using the factory-shipped developer, even if the developer is stored in the first chamber 601 at the shipment from the factory, approximately all of the developer transfers to the chambers 602 and 603 by the rotations of the agitators 611, 612 and 613. Therefore, when the first agitator 611 continues to rotate, the remaining amount of the developer in the first chamber 601 becomes approximately 0%. However, when the developer is remaining in the first chamber 601, a determination can be made that the remaining developer is a solidified developer.

When the developer is consumed accompanying the image forming process and the remaining amount of the developer in the second chamber 602 becomes approximately 0%, the amount of the developer is insufficient just with the developer remaining in the third chamber 603. Therefore, a determination can be made that the developer is necessary to be replenished into the developer container 60.

In case of using the replenishing developer, immediately after the developer is replenished, the remaining amount of the developer in each of the chambers 601, 602 and 603 is approximately 100% , respectively. However, the developer is consumed accompanying the image forming process. Generally, the remaining amount of the developer becomes approximately 0% in the first chamber 601 and the second chamber 602 in this order. When the remaining amount of the developer in the chambers 601 and 602 is approximately 0%, the amount of the developer is insufficient just with the developer remaining in the third chamber 603. Therefore, a determination can be made that the developer is necessary to be replenished into the developer container 60. When the developer is remaining in the first chamber 601 but the remaining amount of the developer in the second chamber 602 is approximately 0%, a determination can be made that the developer remaining in the first chamber 601 is a solidified developer.

When the developer is remaining in the second chamber 602 and the remaining amount of the developer in the first chamber 601 is approximately 0%, there are cases in which the developer remaining in the chambers 602 and 603 have deteriorated over time. For example, in case of using a mixture of a carrier and toner as the developer, a percentage of the carrier in a mixture ratio of the toner and the carrier is excessive in such a developer. If such a developer is used, an image quality of the image formed in the image forming process deteriorates. Therefore, in the present embodiment, when the developer remains in the second chamber 602 and the remaining amount of the developer in the first chamber 601 is approximately 0%, the MFP 1 notifies the user as to the deterioration of the developer.

For detecting the remaining amount of the developer in the developer container 60, developer sensors 81 and 82 are provided at bottom parts of the chambers 601 and 602, respectively. The developer sensors 81 and 82 are formed of photo interrupters as photo detectors, respectively. The developer sensors 81 and 82 output a detection signal which is an analog voltage signal.

Figure 3:
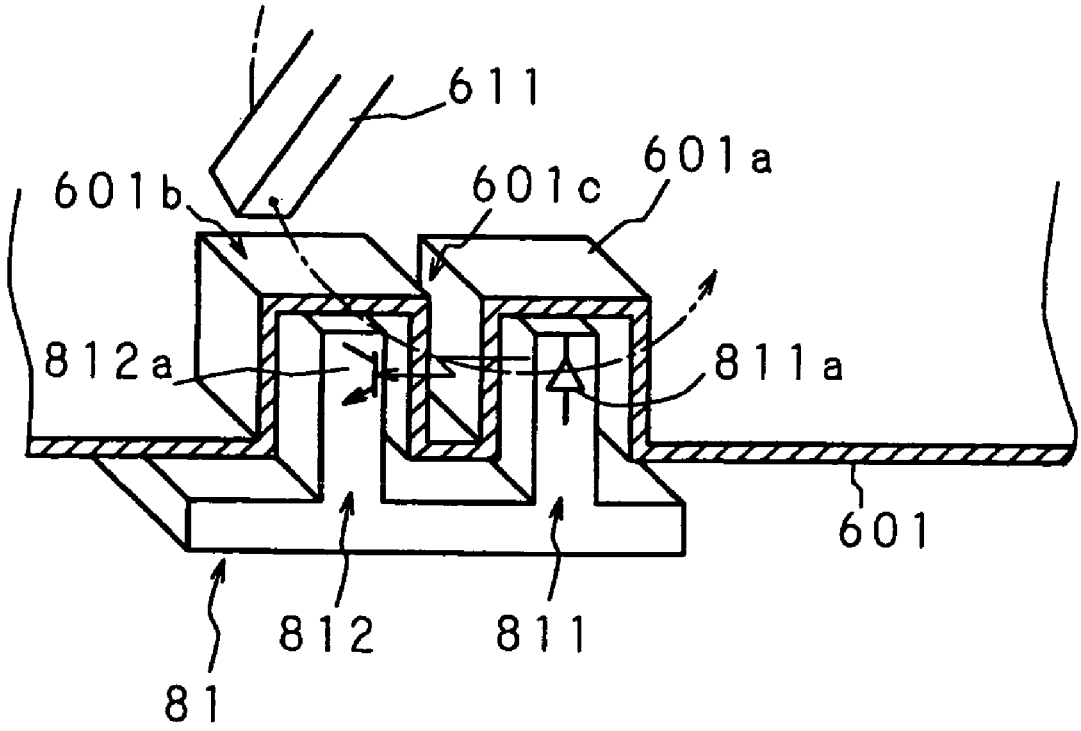
FIG. 3 shows a structure of the developer container and developer sensors provided in the MFP according to an embodiment of the present invention.

A configuration of the first developer sensor 81 and the first chamber 601 and a configuration of the second developer sensor 82 and the second chamber 602 are approximately the same. Therefore, in the following, the configuration of the first developer sensor 81 and the first chamber 601 will be described. FIG. 3 shows the configuration of the first chamber 601 and the first developer sensor 81 of the developer container 60. FIG. 3 is a cross-sectional view of the first developer sensor 81 and a part of the first chamber 601 in proximity to a part where the first developer sensor 81 is equipped.

Two protrusions 811 and 812 are formed on the first developer sensor 81. A light emitter 811*a* of the photo interrupter is embedded in the protrusion 811. A light receiver 812*a* of the photo interrupter is embedded in the other protrusion 812. Such a first developer sensor 81 is emitting light from the light emitter 811*a* at all times. Meanwhile, on the bottom part of the first chamber 601, two concave parts 601*a* and 601*b* are formed in proximity to one another protruding inward so that the two protrusions 811 and 812 of the first developer sensor 81 just fit in from an outer side of the first chamber 601. At least parts of the concave parts 601*a* and 601*b* facing one another are formed of a transparent member. The rotating first agitator 611 passes through a clearance 601*c* between the concave parts 601*a* and 601*b*.

Therefore, accompanying the rotation of the first agitator 611, the developer that existed in the clearance 601*c* is scraped out from the clearance 601*c*. However, in case the developer is accumulated to at least an apex part or higher of the concave parts 601*a* and 601*b* protruding inward to the first chamber 601, the clearance 601*c* between the concave parts 601*a* and 601*b* is filled immediately by the developer. A period of time required for the developer to fill the clearance 601*c* is influenced by the remaining amount of the developer in the first chamber 601.

Meanwhile, the light emitted from the light emitter 811*a* of the photo interrupter is received by the light receiver 812*a* of the photo interrupter via the clearance 601*c* between the concave parts 601*a* and 601*b* formed of a transparent member. The presence or the absence of the developer in the clearance 601*c* in this case is detected. A voltage signal, which is proportional to a light receiving amount of the light receiver 812*a* (a penetrated light amount that penetrated through the first chamber 601), is an output signal of the first developer sensor 81. Further, the present invention is not limited to a configuration in which the light emitter 811*a* is emitting the light at all times. For example, the light can be emitted when determining the status of the developer.

An electrophotographic image forming device uses a magnetic developer and a non-magnetic developer. In case of using the magnetic developer, the remaining amount of the developer can be detected by a magnetic detection. In case of using the non-magnetic developer, the remaining amount of the developer can be detected by detecting the penetrated light amount in the developer container 60 by the photo detector. In the present embodiment, the photo detector which can detect both the magnetic developer and the non-magnetic developer is used as the developer sensor. Further, in place of the photo detector, a pressure sensor can be used.

Figure 4:
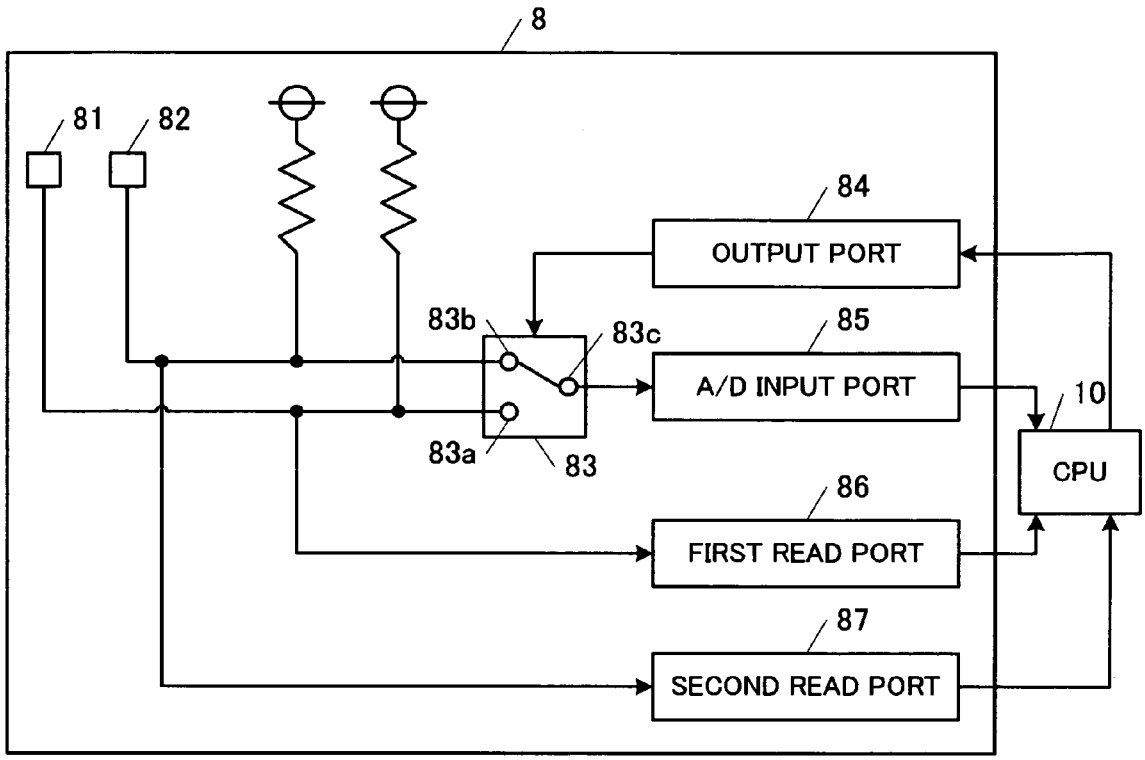
FIG. 4 is a block diagram showing an arrangement of a status detecting unit provided in the MFP according to an embodiment of the present invention.

FIG. 4 is a block diagram showing a configuration of the status detecting unit 8. The status detecting unit 8 includes the developer sensors 81 and 82 provided in the chambers 601 and 602 shown in FIGS. 2 and 3, respectively. The status detecting unit 8 also includes a switching unit 83 formed of an analog switch, an output port 84, an A/D input port 85 and read ports 86 and 87. The output port 84, the A/D input port 85 and the read ports 86 and 87 are respectively connected to the CPU 10. A digital signal is input and output between each of these units and the CPU 10. The developer sensors 81 and 82 are connected to the read ports 86 and 87 in one-to-one correspondence.

The switching unit 83 includes two input terminals 83*a* and 83*b* and one output terminal 83*c*. An analog signal input from the first input terminal 83*a* or the second input terminal 83*b* is output from the output terminal 83*c*. The developer sensors 81 and 82 are connected to the input terminals 83*a* and 83*b* in one-to-one correspondence. The A/D input port 85 is connected to the output terminal 83*c*.

The switching unit 83 is connected to the output port 84. A switching operation between the first input terminal 83*a* and the second input terminal 83*b* is carried out by outputting a switching control signal from the CPU 10 via the output port 84 to the switching unit 83. That is, the CPU 10 controls the switching of the switching unit 83. The CPU 10 switches the switching unit 83 to the second input terminal 83*b* immediately after the shipment from the factory (in case of the factory-shipped developer). After the developer is replenished even once (in case of the replenishing developer), the CPU 10 switches the switching unit 83 to the first input terminal 83*a*. Further, a selection of whether to use the factory-shipped developer or the replenishing developer can be input from the operation panel 31 by the user. Then, according to the input content, the CPU 10 can carry out the switching operation.

The CPU 10 determines the status of the developer relating to the factory-shipped developer. In this case, the CPU 10 controls to switch the switching unit 83 to the second input terminal 83*b* (to the second chamber 602). At this time, a detection signal of the second developer sensor 82 is output from the output terminal 83*c* to the A/D input port 85. The CPU 10 also determines the status of the developer relating to the replenishing developer. In this case, the CPU 10 controls to switch the switching unit 83 to the first input terminal 83*b* (to the first chamber 601). At this time, a detection signal of the first developer sensor 81 is output from the output terminal 83*c* to the A/D input port 85.

The configuration of the first developer sensor 81 provided in the first chamber 601, the switching unit 83, the A/D input port 85, the first read port 86 and the CPU 10 is similar to the configuration of the second developer sensor 82 provided in the second chamber 602, the switching unit 83, the A/D input port 85, the second read port 87 and the CPU 10. Therefore, in the following, the configuration relating to the first developer sensor 81 will be described mainly.

The first developer sensor 81 outputs an analog detection signal proportional to the penetrated light amount that penetrated through the first chamber 601 (specifically, the clearance 601*c*). The output detection signal is output to the first input terminal 83*a* of the switching unit 83 and the first read port 86. Furthermore, in case the switching unit 83 is switched to the first input terminal 83*a*, the detection signal is output via the output terminal 83*c* to the A/D input port 85.

The A/D input port 85 is formed of an A/D converter. The input analog detection signal is converted into a digital detection signal having a value of "0" or larger and "1" or smaller. Then, the converted detection signal is output to the CPU 10. Since the first developer sensor 81 is continuously outputting the detection signal, the detection signal is input continuously to the CPU 10.

The developer in the first chamber 601 is agitated by the first agitator 611 rotating in the first chamber 601. Therefore, the amount of the developer existing in the clearance 601*c* changes. According to the change in the amount of the developer existing in the clearance 601*c*, a value of the detection signal output by the first developer sensor 81 also changes. The CPU 10 obtains a time change of the value of the detection signal input to the CPU 10. Then, in accordance with the obtained time change of the detection signal, the CPU 10 calculates the remaining amount of the developer in the first chamber 601. In this case, the CPU 10 obtains the time change of the value of the detection signal in accordance with a number of clock signals input to the CPU 10 or a time counted by a timer (not shown).

In the following, the light receiver 812*a* of the first developer sensor 81 is formed so as to output a low voltage when the penetrated light amount is large and to output a high voltage when the penetrated light amount is small. For example, the light receiver 812*a* is formed so as to output a voltage signal inversely proportional to the penetrated light amount. In case there is nothing between the two protrusions 811 and 812 of the first developer sensor 81 (for example, in case the developer container 60 has been removed), the penetrated light amount is 100% and the value of the digital detection signal is "0". In case a space between the protrusions 811 and 812 is shielded (for example, in case the first agitator 611 is passing through the clearance 601*c*), the penetrated light amount is 0% and the value of the digital detection signal is "1".

The penetrated light amount detected by the first developer sensor 81 decreases to approximately 0% while the first agitator 611 passes through the clearance 601*c* between the concave parts 601*a* and 601*b*. In other cases, the penetrated light amount is influenced by the remaining amount of the developer. In case the switching unit 83 is switched to the first input terminal 83*a*, a volume and a change in the penetrated light amount depending on the remaining amount of the developer can be classified into following several statuses.

Under a state in which the remaining amount of the developer in the first chamber 601 is approximately 100% , the penetrated light amount hardly changes even when the developer is agitated by the first agitator 611. The penetrated light amount is maintained at approximately 0% at all times. Therefore, the value of the detection signal output from the A/D input port 85 to the CPU 10 is approximately "1" at all times. That is, in case the detection signal having the value of "1" continues to be input to the CPU 10 at all times, the CPU 10 detects that the remaining amount of the developer in the first chamber 601 is approximately 100% .

Under a state in which the remaining amount of the developer in the first chamber 601 is approximately 0%, the penetrated light amount decreases to approximately 0% when the first agitator 611 passes through the clearance 601*c*. In other cases, the penetrated light amount is maintained at approximately 100% . Therefore, only when the first agitator 611 passes through the clearance 601*c*, the value of the detection signal output from the A/D input port 85 to the CPU 10 is approximately "1". In other cases, the value of the detection signal is approximately "0". That is, suppose that a prescribed period of time is shorter than a period of time from when the first agitator 611 passes through the clearance 601*c* until when the first agitator 611 enters into the clearance 601*c*. Then, in case the detection signal having the value of "0" continues to be input to the CPU 10 for the prescribed period of time or longer, the CPU 10 detects that the remaining amount of the developer in the first chamber 601 is approximately 0%.

Furthermore, in case the remaining amount of the developer is an intermediate amount between 0% and 100%, immediately after the developer is scraped out by the first agitator 611 passing through the clearance 601*c* between the concave parts 601*a* and 601*b* accompanying the agitation of the developer by the first agitator 611, there is a period of time when the developer does not exist in the clearance 601*c* of the first chamber 601. This period of time corresponds approximately to the remaining amount of the developer in the first chamber 601. Therefore, by counting this period of time, the CPU 10 detects the remaining amount of the developer in the first chamber 601.

In the above-described case, for example, the ROM 21 is necessary to previously store a table indicating relationships between patterns of the time change of the detection signal and the remaining amounts of the developer in the first chamber 601. In this case, the CPU 10 obtains the time change of the input detection signal. Then, the CPU 10 compares a pattern of the obtained time change with patterns stored in the ROM 21. The CPU 10 determines the remaining amount of the developer corresponding to the most similar pattern to be the remaining amount of the developer in the first chamber 601. Further, a plurality of similar patterns can be selected and an average value of the remaining amounts of the developer corresponding to each of the selected patterns can be determined as the remaining amount of the developer in the first chamber 601.

Alternatively, the ROM 21 is necessary to previously store as a function, relationships between durations of the detection signal having a prescribed value and the remaining amounts of the developer in the first chamber 601. In this case, the CPU 10 clocks the duration of the input detection signal. The CPU 10 substitutes the clocked duration in the function stored in the ROM 21 and calculates the remaining amount of the developer in the first chamber 601.

The switching unit 83 switches between the output of the detection signal of the first developer sensor 81 and the output of the detection signal of the second developer sensor 82. Therefore, the CPU 10 obtains only one of the remaining amount of the developer in the first chamber 601 and the remaining amount of the developer in the second chamber 602. The ROM 21 previously stores a prescribed primary remaining amount and a secondary remaining amount. The primary remaining amount (the secondary remaining amount) is the remaining amount of the developer of approximately 0% relating to the first chamber 601 (the second chamber 602). Further, the primary remaining amount and the secondary remaining amount can be the same value or different values.

When the remaining amount of the developer in the first chamber 601 is obtained, the CPU 10 determines whether the obtained remaining amount of the developer is the primary remaining amount or larger. In case the remaining amount of the developer is the primary remaining amount or larger, the CPU 10 determines that the developer is remaining in the first chamber 601. In case the remaining amount of the developer is less than the primary remaining amount, the CPU 10 determines that the remaining amount of the developer in the first chamber 601 is approximately 0%. In the same manner, when the remaining amount of the developer in the second chamber 602 is obtained, the CPU 10 determines whether the obtained remaining amount of the developer is the secondary remaining amount or larger.

The first read port 86 compares the input analog detection signal (in other words, a voltage signal) with a voltage signal indicating a prescribed voltage (hereinafter referred to as the "prescribed voltage signal"). The prescribed voltage signal is previously set in the first read port 86. The prescribed voltage signal is approximately equal to the detection signal output by the first developer sensor 81 when the remaining amount of the developer in the first chamber 601 is a third remaining amount (for example, approximately 0%) and the first agitator 611 has not passing through the clearance 601*c*. In accordance with a comparison result of the detection signal and the prescribed voltage signal, the first read port 86 detects whether the remaining amount of the developer in the first chamber 601 is the third remaining amount or larger. When the first read port 86 detects that the remaining amount of the developer in the first chamber 601 is the third remaining amount or larger, the first read port 86 outputs a warning signal, which is a digital signal, to the CPU 10.

The first read port 86 includes a reference voltage generator, a comparator and a timer or the like. The reference voltage generator generates the prescribed voltage signal. The voltage signal input to the first read port 86 and the prescribed voltage signal generated by the reference voltage generator are output to the comparator.

In case the input voltage signal is the prescribed voltage signal or larger, the comparator outputs a high-level signal to the timer. The prescribed period of time is set previously in the timer. When the high-level signal is input, the timer starts to clock and clocks the duration of the input high-level signal. When the counted period of time reaches the prescribed period of time or longer, the timer outputs the warning signal to the CPU 10. In case the input voltage signal is less than the prescribed voltage signal, the comparator outputs a low-level signal to the timer. When the low-level signal is input, the timer stops counting and returns the clocking result to "0".

Accompanying the decrease in the remaining amount of the developer in the first chamber 601, the voltage signal less than the prescribed voltage signal is input continuously to the comparator. Therefore, the duration of the high-level signal input from the comparator to the timer decreases. The duration of the high-level signal input to the timer when the remaining amount of the developer in the first chamber 601 is the third remaining amount can be set previously in the timer. Accordingly, when the first read port 86 detects that the remaining amount of the developer in the first chamber 601 is the third remaining amount or larger (in this case, more than approximately 0%, in other words, the developer is remaining in the first chamber 601), the first read port 86 outputs the warning signal to the CPU 10. As described above, the first developer sensor 81 and the first read port 86 detect whether the developer of the third remaining amount or larger is remaining in the first chamber 601. In other words, the first developer sensor 81 and the first read port 86 detect the presence or the absence of the developer in the first chamber 601.

Further, for example, the first read port 86 can include a comparator and a reference voltage generator. When a detection signal of the prescribed voltage signal or larger is input, without clocking the duration of the detection signal, the first read port 86 can output the warning signal to the CPU 10. In this case, in accordance with the timing in which the warning signal is input and the timing of the rotation of the first agitator 611, the CPU 10 can receive the warning signal input after an elapse of a prescribed period of time from when the first agitator 611 passes through the clearance 601*c*. The CPU 10 can ignore other input alarm signals. In this case, an influence of the first agitator 611 or an influence due to the developer agitated by the first agitator 611 (the second agitator 612) passing through the clearance 601*c* being scraped out temporarily from the clearance 601*c* is eliminated.

The second read port 87 will be described. The second read port 87 detects whether the remaining amount of the developer in the second chamber 602 is a fourth remaining amount (for example, approximately 0%) or lower in accordance with the comparison result of the detection signal and the prescribed voltage signal. When detecting that the remaining amount of the developer in the second chamber 602 is the fourth remaining amount or lower, the second read port 87 outputs a warning signal, which is a digital signal, to the CPU 10. The configuration of the second read port 87 is the same as the configuration of the first read port 86. In this case, when the input voltage signal is the prescribed voltage signal or lower, the comparator outputs a high-level signal to the timer. When the input voltage signal exceeds the prescribed voltage signal, the comparator outputs a low-level signal to the timer.

The warning signal is input to the CPU 10 from both the first read port 86 and the second read port 87. However, in case of the factory-shipped developer, the CPU 10 ignores the warning signal from the second read port 87. In case of the replenishing developer, the CPU 10 ignores the warning signal from the first read port 86.

As described above, the first developer sensor 81, the A/D input port 85, the first read port 86 and the CPU 10 implement one detecting function. The first developer sensor 81, the A/D input port 85 and the CPU 10 implement the first remaining amount detecting function of one sensor for detecting the remaining amount of the developer in the first chamber 601. The first developer sensor 81 and the first read port 86 implement the second remaining amount detecting function for detecting whether the developer of the prescribed amount or larger is remaining in the first chamber 601 (in this case, the presence or the absence of the developer). In the same manner, the second developer sensor 82, the A/D input port 85 and the CPU 10 implement the first remaining amount detecting function of another sensor. The second developer sensor 82 and the second read port 87 implement the second remaining amount detecting function of the other sensor.

The switching unit 83 functions to detect the remaining amount of the developer by the first remaining amount detecting function of one sensor. The switching unit 83 functions not to detect the remaining amount of the developer by the first remaining amount detecting function of the other sensor. Therefore, the A/D input port 85 is shared between one sensing function and the other sensing function.

The CPU 10 determines a status of the remaining amount of the developer. FIG. 5 shows examples of the data stored in the ROM 21. In the drawing, referenced numerals 211 and 212 denote data tables referenced by the CPU 10 when determining the status relating to the factory-shipped developer and the replenishing developer. The data tables 211 and 212 are previously stored in the ROM 21.

In case of determining the status relating to the factory-shipped developer, the CPU 10 refers to the data table 211. When the warning signal is input to the CPU 10 from the first read port 86 which detects the presence or the absence of the developer in the first chamber 601 (in the drawing, "WARNING SIGNAL INPUT"), the CPU 10 determines that the developer is solidified in the first chamber 601 (in the drawing, "DEVELOPER SOLIDIFIED"). In this case, the remaining amount of the developer in the second chamber 602 is not necessary to be considered. When the warning signal is not input to the CPU 10 (in the drawing, "WARNING SIGNAL NOT INPUT") and the CPU 10 determines that the remaining amount of the developer in the second chamber 602 is less than the secondary remaining amount (in the drawing, "LESS THAN SECONDARY REMAINING AMOUNT"), the CPU 10 determines that the remaining amount of the developer stored in the developer container 60 is insufficient and that the developer is necessary to be replenished (in the drawing, "REPLENISHING NECESSARY").

In the above-described case, the CPU 10 displays a prescribed message (for example, "developer is solidified" or "please replenish developer") on the operation panel 31. In this case, until the developer is replenished in the developer container 60, the MFP 1 is restricted from carrying out a new printing operation by the control of the CPU 10. Therefore, the user replenishes the developer in the developer container 60 or replaces the developer container 60 with a new developer container 60.

When the warning signal is not input to the CPU 10 ("WARNING SIGNAL NOT INPUT") and the CPU 10 determines that the remaining amount of the developer in the second chamber 602 is the secondary remaining amount or larger (in the drawing, "SECONDARY REMAINING AMOUNT OR LARGER"), the CPU 10 determines that the developer of the detected remaining amount (a sufficient amount or an amount that is not sufficient but not necessary to be replenished immediately) is remaining in the developer container 60 (in the drawing, "SUFFICIENT AMOUNT TO FEW AMOUNT"). When the remaining amount of the developer is few, the CPU 10 displays a prescribed message (for example, "remaining amount of developer has become small") on the operation panel 31. In this case, the user prepares the developer to be replenished to the developer container 60 or a new developer container 60.

In case of determining the status relating to the replenishing developer, the CPU 10 refers to the data table 212. When the warning signal is input to the CPU 10 from the second read port 87 for detecting the presence or the absence of the developer in the second chamber 602 (in the drawing, "WARNING SIGNAL INPUT") and the CPU 10 determines that the remaining amount of the developer in the first chamber 601 is the primary remaining amount or larger (in the drawing, "PRIMARY REMAINING AMOUNT OR LARGER"), the CPU 10 determines that the developer is solidified in the first chamber 601 (in the drawing, "DEVELOPER SOLIDIFIED"). When the warning signal is input to the CPU 10 (in the drawing "WARNING SIGNAL INPUT") and the CPU 10 determines that the remaining amount of the developer in the first chamber 601 is less than the primary remaining amount (in the drawing, "LESS THAN PRIMARY REMAINING AMOUNT"), the CPU 10 determines that the remaining amount of the developer stored in the developer container 60 is insufficient and the developer is necessary to be replenished (in the drawing, "REPLENISHING NECESSARY").

In the above-described case, the CPU 10 displays a prescribed message (for example, "developer is solidified" or "please replenish developer") on the operation panel 31. In this case, until the developer is replenished in the developer container 60, the MFP 1 does not carry out a new printing operation. Therefore, the user replenishes the developer in the developer container 60 or replaces the developer container 60 with a new developer container 60.

When the warning signal is not input to the CPU 10 (in the drawing, "WARNING SIGNAL NOT INPUT") and the CPU 10 determines that the remaining amount of the developer in the first chamber 601 is the primary remaining amount or larger (in the drawing, "PRIMARY REMAINING AMOUNT OR LARGER"), the CPU 10 determines that the detected remaining amount of the developer (a sufficient amount or an amount not sufficient but not necessary to be replenished immediately) is remaining in the developer container 60 (in the drawing, "SUFFICIENT AMOUNT TO FEW AMOUNT"). When the remaining amount of the developer is few, the CPU 10 displays a prescribed message (for example, "remaining amount of developer has become small") on the operation panel 31. In this case, the user prepares the developer to be replenished in the developer container 60 or a new developer container 60.

When the warning signal is not input to the CPU 10 ("WARNING SIGNAL NOT INPUT") and the CPU 10 determines that the remaining amount of the developer in the first chamber 601 is less than the primary remaining amount (in the drawing, "LESS THAN PRIMARY REMAINING AMOUNT"), the CPU 10 determines that the developer is remaining in the second chamber 602 but the remaining developer is probably deteriorated (in the drawing, "DEVELOPER DETERIORATED"). In this case, the CPU 10 displays a prescribed message (for example, "developer is deteriorated") on the operation panel 31. In this case, the user carries out an image forming process by understanding a deterioration of an image quality. Alternatively, the user abandons the deteriorated developer and replenishes the developer in the developer container 60. Alternatively, the user replaces the developer container 60 with a new developer container 60.

The above-described MFP 1 has a simple configuration. The MFP 1 determines the status (the presence or the absence, the remaining amount, the solidification and the deterioration) of the developer. Then, the MFP 1 notifies the user as to the status of the developer. Although the factory-shipped developer and the replenishing developer are different, the CPU 10 accurately determines the status of the developer by the switching operation of the switching unit 83 and by changing the data tables 211 and 212 referenced when determining the status of the developer.

Although the MFP 1 includes two developer sensors 81 and 82, since only one A/D input port is provided, an increase in the costs of the MFP 1 can be prevented.

In the above-described embodiment, the factory-shipped developer and the replenishing developer are different. However, the amounts of the factory-shipped developer and the replenishing developer can be the same. For example, the switching unit 83, the output port 84 and the first read port 86 are not required to be provided in the status detecting unit 8 which only determines the status of the developer relating to the replenishing developer. One detecting function is implemented by the first developer sensor 81, the A/D input port 85 connected to the first developer sensor 81 and the CPU 10. The other detecting function is implemented by the second developer sensor 82 and the second read port 87. That is, the remaining amount of the developer in the first chamber 601 is detected precisely and the remaining amount of the developer in the second chamber 602 is detected roughly. Then, in accordance with the detection results by the two detecting functions, the CPU 10 refers to the table 212 and determines the status of the developer.

A developer sensor can be provided in the third chamber 603 and the solidification of the developer in the second chamber 602 can be detected. Furthermore, the developer sensors 81 and 82 can be formed so as to output a high voltage when the penetrated light amount is large and to output a low voltage when the penetrated light amount is small.

The invention claimed is:

1. An image forming device, comprising:

a developer container which is sectioned into a plurality of chambers;

an image forming unit which forms an image by using a developer supplied from the developer container;

sensors which are provided in at least two of the chambers of the developer container and detect a remaining amount of the developer in the chambers; and a determining unit which determines a quantity and a quality of the developer in the developer container in accordance with the remaining amount of the developer detected by each of the sensors.

2. The image forming device according to claim 1, further comprising:

an input port which inputs an output signal of the sensors to the determining unit; and an analog-to-digital converter which carries out an analog-to-digital conversion of the output signal of the sensors and inputs a digital signal to the determining unit.

3. The image forming device according to claim 2, further comprising:

a switching unit which switches the output signal of the sensors and inputs the output signal to the analog-to-digital converter.

4. The image forming device according to claim 3, wherein when the output signal of one of the sensors is input to the analog-to-digital converter, the output signal of another sensor is input to the determining unit via the input port.

5. The image forming device according to claim 4, wherein the determining unit determines the status of the developer in each of the chambers of the developer container in accordance with the digital signal of each of the sensors from the analog-to-digital converter and an input from the input port of each of the sensors.

6. The image forming device according to claim 5, wherein the determining unit determines the remaining amount of the developer in each of the chambers of the developer container and a presence, an absence and a solidification of the developer.

7. An image forming device comprising:

a developer container which is sectioned into a plurality of chambers;

an image forming unit which forms an image by using a developer supplied from the developer container;

sensors which are provided in at least two of the chambers of the developer container and detect a remaining amount of the developer in the chambers; and a determining unit which determines a status of the developer in the developer container in accordance with the remaining amount of the developer detected by the sensors, wherein the developer is a non-magnetic developer and the sensors are photo interrupters.

8. An image forming device, comprising:

means for storing a developer sectioned into a plurality of chambers;

means for forming an image by using the developer supplied from the means for storing the developer;

means for detecting a remaining amount of the developer in each of the chambers, provided in at least two of the chambers of the means for storing the developer; and means for determining a quantity and a quality of the developer in the means for storing the developer in accordance with the remaining amount of the developer detected by the means for detecting.

9. An image forming device, comprising:

means for storing a developer sectioned into a plurality of chambers;

means for forming an image by using the developer supplied from the means for storing the developer;

means for detecting a remaining amount of the developer in each of the chambers, provided in at least two of the chambers of the means for storing the developer;

means for detecting, which are provided in at least two of the chambers of the means for storing the developer, whether the developer of a prescribed amount or larger is remaining in the chambers; and means for determining a quantity and a quality of the developer in the means for storing the developer in accordance with detection results of the means for detecting the remaining amount of the developer in one of the chambers and the means for detecting whether the developer of the prescribed amount or larger is remaining in another chamber.

10. The image forming device according to claim 9, further comprising means for operating the means for detecting the remaining amount of the developer in one of the chambers and for not operating the means for detecting the remaining amount of the developer in the other chamber.

11. The image forming device according to claim 9, further comprising means for notifying a determination result of the means for determining the status of the developer.

12. An image forming device comprising:

means for storing a developer sectioned into a plurality of chambers;

means for forming an image by using the developer supplied from the means for storing the developer;

means for detecting a remaining amount of the developer in each of the chambers, provided in at least two of the chambers of the means for storing the developer;

means for detecting, which are provided in at least two of the chambers of the means for storing the developer, whether the developer of a prescribed amount or larger is remaining in the chambers; and means for determining a status of the developer in the means for storing the developer in accordance with detection results of the means for detecting the remaining amount of the developer in one of the chambers and the means for detecting whether the developer of the prescribed amount or larger is remaining in another chamber, wherein the means for determining the status of the developer determines at least one status of whether the remaining amount of the developer in the means for storing the developer is sufficient, whether the developer is necessary to be replenished, whether the developer is deteriorated and whether the developer is solidified.

13. The image forming device according to claim 12, further comprising means for notifying whether the remaining amount of the developer in the means for storing the developer is sufficient, whether the developer is necessary to be replenished, whether the developer is deteriorated and whether the developer is solidified.

14. An image forming method, comprising:

detecting a remaining amount of a developer in a first chamber of a developer container;

detecting whether a developer in a second chamber located downstream of the first chamber of the developer container is a primary prescribed amount or larger;

detecting a remaining amount of the developer in the second chamber of the container;

detecting whether the developer in the first chamber of the container is the primary prescribed amount or larger; and determining a status of the developer in the container in accordance with each of detection results.

15. The image forming method according to claim 14, wherein at the step of determining the status of the developer, one of statuses of whether the developer is sufficient, whether the developer is necessary to be replenished, whether the developer is solidified and whether the developer is deteriorated is determined.

16. The image forming method according to claim 15, wherein the developer is determined to be sufficient when the remaining amount of the developer in the first chamber is a secondary prescribed amount or larger and the remaining amount of the developer in the second chamber is the primary prescribed amount or larger, or when the remaining amount of the developer in the first chamber is the primary prescribed amount or larger and the remaining amount of the developer in the second chamber is a third prescribed amount or larger.

17. The image forming method according to claim 15, wherein the developer is determined necessary to be replenished when the remaining amount of the developer in the first chamber is the primary prescribed amount or larger and the remaining amount of the developer in the second chamber is less than a third prescribed amount, or when the remaining amount of the developer in the first chamber is less than a secondary prescribed amount and the remaining amount of the developer in the second chamber is the primary prescribed amount or smaller.

18. The image forming method according to claim 15, wherein the developer is determined to be solidified when the remaining amount of the developer in the first chamber is less than the primary prescribed amount or when the remaining amount of the developer in the first chamber is the secondary prescribed amount or larger and the remaining amount of the developer in the second chamber is less than the primary prescribed amount.

19. The image forming method according to claim 15, wherein the developer is determined to be deteriorated when the remaining amount of the developer in the first chamber is less than the secondary prescribed amount and the remaining amount of the developer in the second chamber is the primary prescribed amount or larger.

20. The image forming method according to claim 15, further comprising prohibiting a formation of an image when determining that the developer is necessary to be replenished, the developer is solidified or the developer is deteriorated.

* * * * *